United States Patent [19]

Hayashi et al.

[11] Patent Number: 4,735,000

[45] Date of Patent: Apr. 5, 1988

[54] APPARATUS FOR DRYING SUBSTRATES

[76] Inventors: Noriyuki Hayashi, 480-1 Takamiyo-cho; Eiichiro Hayashi, 1028 Ono-cho, both of Hikone-shi, Shiga; Hisao Nishizawa, 290 Yoshida, Toyosato-cho, Inugami-gun, Shiga, all of Japan

[21] Appl. No.: 47,169

[22] Filed: May 7, 1987

[30] Foreign Application Priority Data

May 9, 1986 [JP] Japan ..... 61-70586[U]

[51] Int. Cl.[4] ..... F26B 17/24

[52] U.S. Cl. ..... 34/58; 34/8; 34/186

[58] Field of Search ..... 34/58, 8, 186, 187

[56] References Cited

U.S. PATENT DOCUMENTS 4,677,759 7/1987 Inamura ..... 34/58

FOREIGN PATENT DOCUMENTS 1143151 1/1963 Fed. Rep. of Germany ..... 34/58

*Primary Examiner*—Henry A. Bennet

*Attorney, Agent, or Firm*—Ostrolenk, Faber, Gerb & Soffen

[57] ABSTRACT

An apparatus for drying substrates by means of centrifugal force. Air is introduced into a drying chamber from the top end thereof. A rotary member is provided in the drying chamber, on which is mounted a cassette in which a plurality of substrates to be dried are stored. An auxiliary chamber is disposed at the bottom part of the drying chamber, within which fan blades are provided. An auxiliary exhausting duct is connected to the auxiliary chamber, whereby fine particles of dust produced around the bearing are completely exhausted.

3 Claims, 2 Drawing Sheets

APPARATUS FOR DRYING SUBSTRATES

BACKGROUND OF THE INVENTION

The present invention relates to an apparatus for drying substrates, such as semiconductor substrates, glass plates for liquid crystal devices or the likes (hereinafter referred to as substrates), through high speed rotation. More particularly, the invention relates to an improvement of apparatus of the type wherein the substrates are placed in a rotary member, which is rotated at high speed while fresh air is introduced into the apparatus, so that water droplets adhering on the substrates are dispersed by centrifugal force generated by rotation of the rotary member and the substrates are dried.

With such apparatus, the air or gas used for drying the substrates flows in a circumferential direction of a drying chamber and out through an exhaust duct, and a part of the water droplets dispersed from the substrates are apt to adhere to a peripheral inside wall of the chamber together with fine particles of dust. Not all of the air flows circumferentially in the drying chamber, and a part of the air whirls upwardly in turbulent currents. Such turbulent currents cause water droplets dispersed from the substrates or adhering on the peripheral inside wall to rebound upon or sprinkle over the substrates. Accordingly, the substrates to be dried are apt to be contaminated or impaired by such fine water droplets and fine particles of dust involved in the turbulent currents.

In order to solve the above drawback, proposes use of the Japanese laid-open (unexamined) apparatus patent application No. 60-59740 as shown in FIG. 5 of the accompanying drawings.

According to this laid-open application, the apparatus comprises a casing 101 defining a drying chamber 102 therein, and a rotary member 108 disposed in the drying chamber 102 and carrying a pair of cassettes 111, 111' in which the substrates are stored. The casing 101 includes a lid 103 defining an intake opening 104 for introducing ambient air or an appropriate inert gas, e.g. nitrogen gas, (hereinafter referred to just as air) into the drying chamber. The casing 101 defines an exhaust port 106 in a lower part thereof to be connected with an exhaust duct 107 for discharging the air whirling in the drying chamber therethrough. The rotary member 108 includes a base element 113 having a vane wheel for promoting smooth downward flows of air. Number 115 denotes guide vanes for guiding the downward flows of air.

This apparatus may indeed be improved in comparison with prior conventional apparatus. However, recent semiconductor technology requires that the quality of the substrates on which integrated circuits or desired circuit patterns are formed be extremely high. In view of this requirement, conventional apparatus including that mentioned above cannot meet the requirement, and are still insufficient therefor.

Several causes can be considered. Fine particles of dust are inevitably produced between a drive shaft 110 for rotating the rotary member 108 and a bearing thereof 114, and the fine particles of dust cannot be prevented in the conventional apparatus. The fine particles of dust cannot be completely discharged therefrom, because of lack of sufficient flows of air around the bearing. The turbulent currents caused in the drying chamber include fine particles of dust which serves to contaminate and impair the substrates to be dried.

SUMMARY OF THE INVENTION

The present invention was made having regard to the prior art noted above, and a primary object of the invention is to provide an improved apparatus for drying substrates, which prevents the fine particles of dust produced between the rotary shaft and the bearing thereof, from contaminating the substrates to be dried.

Another object is to improve the efficiency of drying of the substrates.

These objects are accomplished by the present invention which comprises: a casing defining a first chamber therein, at the top end of which an air intake opening is provided for introducing air into the first chamber, a primary exhaust port being provided at the lower part of said first chamber; a drive shaft extending vertically into said first chamber; a bearing for supporting said drive shaft at the lower part of said casing; a rotary member disposed in said first chamber and coupled with said drive shaft for carrying a cassette in which a plurality of the substrates are stored, said rotary member being rotatable to disperse water droplets adhering on the substrates; a second chamber provided at the bottom part of said first chamber so as to surround the adjacent part of said bearing, at the upper part of said second chamber an second opening being provided to communicate with said first chamber; fan blades secured within said second chamber and being rotatable for exhausting air from the second chamber; and an auxiliary exhaust duct connected to said second chamber, for exhausting the air from the second chamber.

Preferrably, the apparatus further comprises a compulsory exhausting means communicated with said second chamber, said means being continued to actuate after the rotary member is stopped.

According to the present invention, the drive shaft for rotating the rotary member is supported by a bearing, which is surrounded so as to form a second chamber. The second chamber communicates with the first chamber through the second opening at the upper part thereof. Part of the flows of air in the first chamber is constantly introduced through the auxiliary opening to the second chamber. All the fine particles of dust produced around the bearing is exhausted through the auxiliary exhaust duct. The fan blades provided within the second chamber promote the downward flow of air, sweeping the fine particles of dust away therefrom.

Thus, according to the present invention, the fine particles of dust produced around the bearing of the drive shaft do not flow into the first chamber, and accordingly not to contaminate and impair the substrates to be dried during drying process. These features provide a substantial improvement in the drying process to realize high quality of the substrates.

Other features and advantages of the invention will become apparent from the following description.

DESCRIPTION OF THE PREFERRED EMBODIMENTS

The invention will be described further with reference to the accompanying drawings illustrating a few examples of apparatus embodying the invention.

Figure 1:
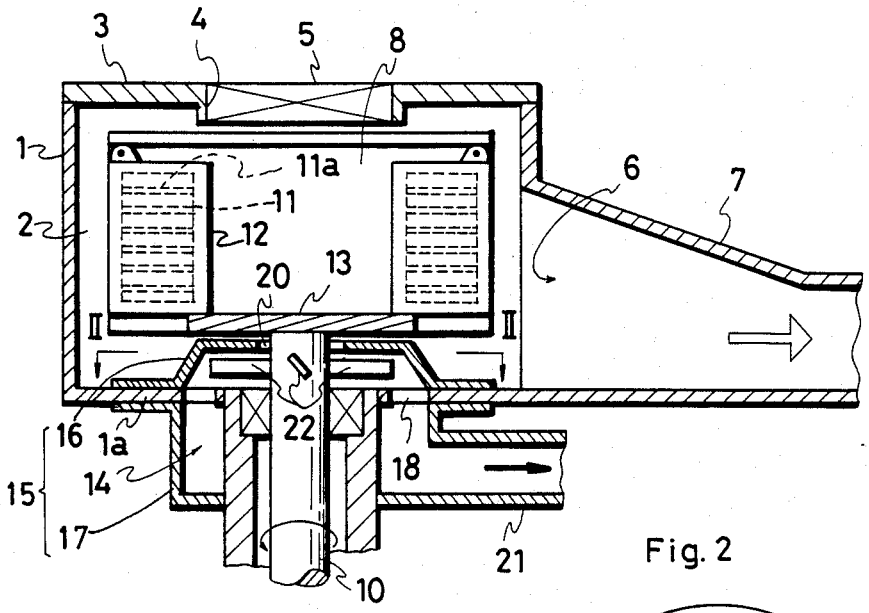
FIG. 1 is a vertical sectional view of the apparatus according to a first embodiment of the invention.
Figure 2:
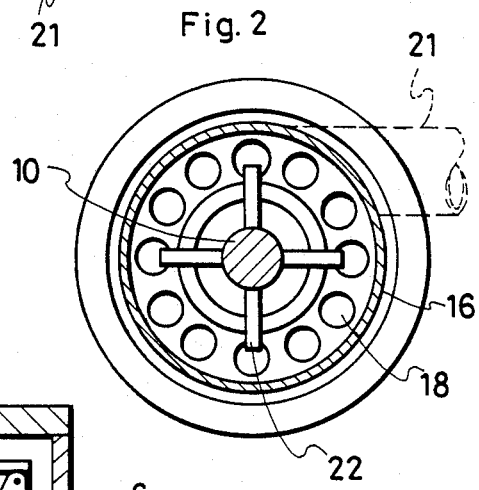
FIG. 2 is a plan view taken on lines II—II of FIG. 1.

Referring to FIGS. 1 and 2 which show a first embodiment of the apparatus according to the present invention. The apparatus comprises a substantially cylindrical casing 1 defining a drying chamber 2, at the top of which a disk lid 3 is mounted. The lid 3 includes an air intake opening 4, in which a dust filter 5 is provided. A primary exhaust port 6 is provided at the lower part of the side wall of the casing 1. The exhaust port 6 is connected, through an exhaust duct 7, to an exhausting device (not shown). In the drying chamber 2 there provided a rotary member 8, which is coupled with a drive shaft 10, and is rotated thereby. The rotary member 8 includes a pair of cassette holders 12 therein for fixedly holding cassette 11 in which a plurality of substrates to be dried 11*a* are stored. The cassette holders 12 are upwardly pivotable relative to the casing 1, and are seated on a rotary base 13. This enables an operator to easily place the cassettes 11 in the holders 12 and remove them therefrom, through the opening 4.

The rotary member 8 is coupled to a drive shaft 10 at the lower end thereof, and is in turn coupled to a driving motor (not shown). The drive shaft 10 is supported by a bearing 14 provided at the lower part of the casing 1.

At the bottom of the drying chamber 2, i.e. immediately below the lower end of the rotary member 8, there is provided an auxiliary chamber 15, which is defined by an inner casing 16 and a cup 17. The inner casing 16 is fixed to a bottom plate 1*a* of the casing 1 so as to cover the bearing 14. The inner casing 16 includes an auxiliary opening 20 thereon, through which the drive shaft 10 extends vertically. The cup 17 is also fixed to the bottom plate 1*a* so as to cover the bearing 14. The portion of bottom plate 1*a* enclosed between the inner casing 16 and the cup 17 includes a plurality of air vents 18 thereon for communicating between the auxiliary chamber 15 and the auxiliary exhaust duct 21. The drive shaft 10 extends vertically through the opening 20 with a clearance therebetween which constitutes a communicating opening for permitting part of the air in the drying chamber 2 to flow into the auxiliary chamber 15. The cup 17 is continuous with an auxiliary exhaust duct 21.

Within the auxiliary chamber 15 fan blades 22 are secured to the drive shaft 10. The fan blades 22 function to exhaust the air from the auxiliary exhaust chamber 15, thereby to completely discharge the fine particles of dust produced around the bearing 14 through exhaust duct 21.

Prior to the drying process, the substrates 11*a* are washed by clean water. An operator places the cassettes 11 in the holders 12, the substrates to be dried 11*a* being stored horizontally in the cassettes 11. After that, the exhaust device (not shown) provided at the end of the exhaust duct 7 is actuated, by which ambient air is introduced into the drying chamber 2 through the dust filter 5. Then, the rotary member 8 is rotated at a predetermined speed, with the result that water droplets adhering to the substrates 11*a* are dispersed by centrifugal force. The air thus introduced flows circumferentially within the drying chamber 2 according to direction of rotation of the rotary member 8. While substantially all of the water droplets and moisture are exhausted from the exhaust duct 7, a part of the air flow is introduced into the auxiliary chamber 15 through the opening 20 as a downward flow of air.

The fan blades 22 are rotated together with the rotary member 8, which promotes the drownward flow of air into the auxiliary chamber 15 and the fine particles of dust produced around the bearing 14 are prevented by the fan blades 22 from entering the drying chamber 2. Instead, the particles of dust are completely exhausted therefrom through the auxiliary duct 21.

As mentioned above, the exhaustion of both water droplets and moisture dispersed from the substrates 11*a*, and the fine particles of dust produced around the bearing 14 are performed separately and independently. As a result, the substrates to be dried are free from any contamination and impairment.

Figure 3:
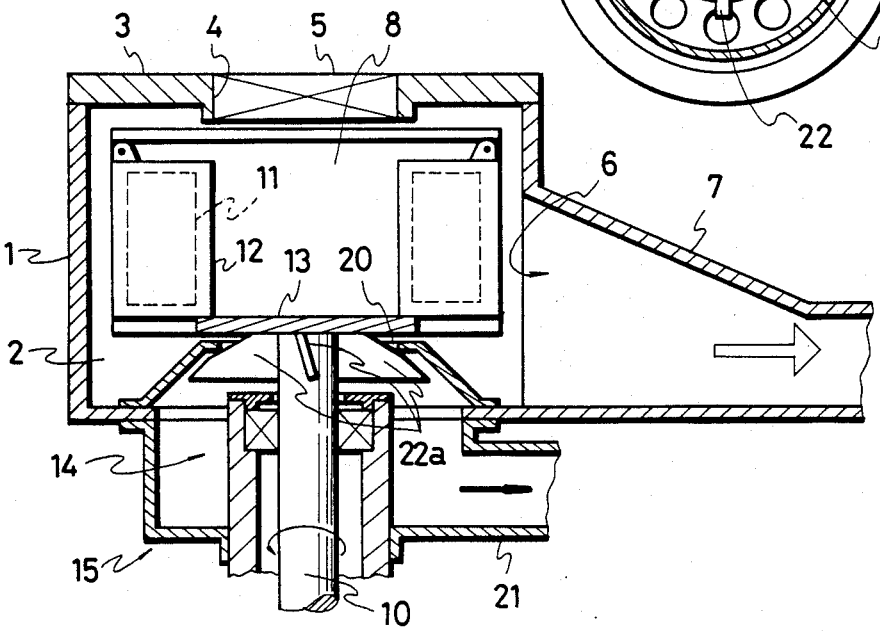
FIG. 3 is a vertical sectional view of the apparatus according to a second embodiment.

FIG. 3 shows a second embodiment of the invention, wherein similar numerals indicate similar elements as in FIG. 1. The apparatus shown in FIG. 3 includes fan blades 22*a* secured to an undersurface of the rotary base 13 and projecting downwardly therefrom. Since the operation of this embodiment are substantially the same as those in the first embodiment, detailed explanation on the operations is omitted.

In the first and second embodiments described above, only the fan blades are employed to exhaust the air from the auxiliary chamber. In these embodiments, a compulsory exhausting device (not shown) may also be provided at the other end of the auxiliary exhaust duct 21, so that the air is exhausted from the auxiliary exhaust chamber 15 at all times even when a drying operation is not taking place. This can prevent the fine particles of dust produced around the bearing 14 from flowing back into the drying chamber 2, thereby further improving the quality of the substrates.

Figure 4:
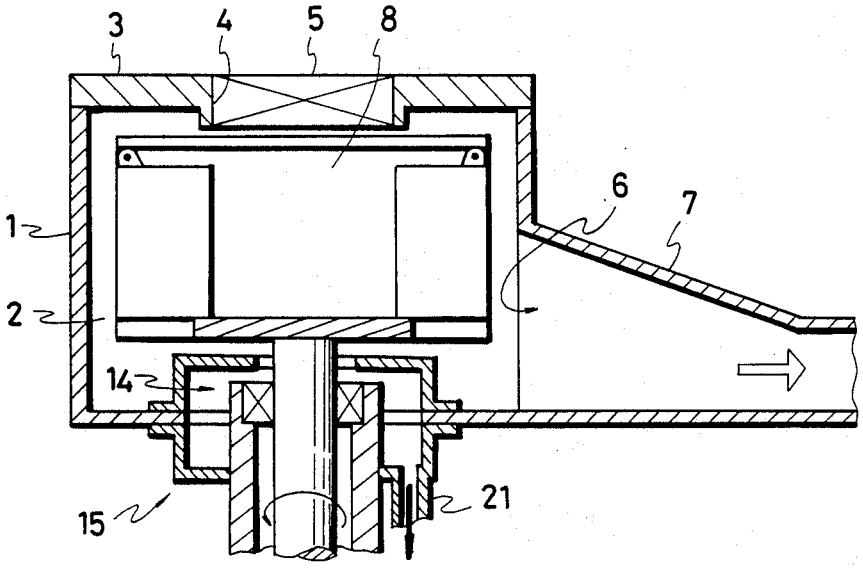
FIG. 4 is a vertical sectional view of the apparatus according to a third embodiment.

FIG. 4 shows a third embodiment of the present invention, in which no fan blades are provided within the auxiliary chamber 15. The auxiliary exhaust duct 21 is connected to an compulsory exhaust device (not shown), instead of the fan blades provided in the first and second embodiments. The fine particles of dust produced around the bearing 14 are exhausted downwards by the exhaust device. Since other operations are substantially the same as the aforementioned embodiments, detailed explanation on this embodiment is omitted.

Figure 5:
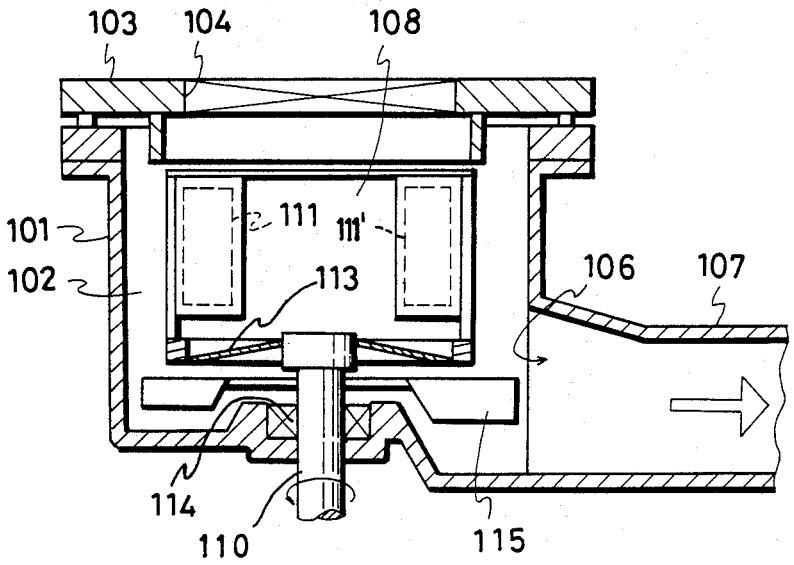
Fig.5 PRIOR ART
FIG. 5 is a vertical sectional view of a conventional apparatus.

In order to attest the advantageous results of the present invention, dust measurements was carried out on the first to third embodiments described above and a conventional apparatus shown in FIG. 5, respectively, under the following specific conditions:

(a) Speed of rotary member 8 was 1,000 r.p.m.

(b) Exhaust capability of the duct 7 was 9 $m^3$/min.

(c) Exhaust capability of the duct 21 was 5 $m^3$/min.

(d) The pickup tube of a dust counter was positioned at a position adjacent to the exhaust port 6.

(e) Dust particles having a diameter of bigger than 0.3 micrometers contained in 8.3 liters were counted by the dust counter.

The results of the measurements were as follows:

In the case of the conventional apparatus, i.e. there provided no auxiliary chamber therein, 272 particles were counted. Whereas, in the case of the apparatus of the above embodiments, zero through four particles were counted.

What is claimed is:

1. An apparatus for drying substrates by means of centrifugal force, comprising:

a casing defining a first chamber therein, at the top end of which an air intake opening is provided for introducing air into the first chamber, a primary exhaust port being provided at the lower part of said first chamber;

a drive shaft extending vertically into said first chamber;

a bearing for supporting said drive shaft at the lower part of said casing;

a rotary member disposed in said first chamber and coupled to said drive shaft for carrying a cassette in which a plurality of the substrates may be stored, said rotary member being rotatable;

a second chamber provided at the bottom part of said first chamber so as to surround the part of said bearing which is adjacent said first chamber, a second opening being provided at the upper part of said second chamber to communicate with said first chamber;

an auxiliary exhaust duct connected to said second chamber; and fan blades secured within said second chamber and being rotatable for exhausting air from the second chamber and through said auxiliary exhaust duct.

2. An apparatus as set forth in claim 1, further comprising a compulsory exhausting means communicating with said second chamber for withdrawing air from said second chamber.

3. Apparatus for drying substrates by means of centrifugal force, comprising:

a casing defining a first chamber therein, at the top end of which an air intake opening is provided for introducing air into the first chamber, a primary exhaust port being provided at the lower part of said first chamber;

a drive shaft extending vertically into said first chamber;

a bearing for supporting said drive shaft at the lower part of said case;

a rotary member disposed in said first chamber and coupled to said drive shaft for carrying a cassette in which a plurality of the substrates may be stored, said rotary member being rotatable;

a second chamber provided at the bottom part of said first chamber so as to surround the part of said bearing which is adjacent said first chamber, a second opening being provided at the upper part of said second chamber in communication with said first chamber;

an auxiliary exhaust duct connected to said second chamber; and compulsory exhausting means communicating with said second chamber for exhausting air from said second chamber and into said auxiliary exhaust duct.

* * * * *